US007768493B2

(12) United States Patent
Choi

(10) Patent No.: US 7,768,493 B2
(45) Date of Patent: Aug. 3, 2010

(54) PLASMA DISPLAY APPARATUS

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 538 days.

(21) Appl. No.: 11/759,655

(22) Filed: Jun. 7, 2007

(65) Prior Publication Data

US 2007/0285374 A1 Dec. 13, 2007

(30) Foreign Application Priority Data

Jun. 8, 2006 (KR) ..... 10-2006-0051654

(51) Int. Cl.
*G09G 3/36* (2006.01)

(52) U.S. Cl. ..... 345/99; 345/60; 345/62; 345/67; 315/169.4

(58) Field of Classification Search ..... 345/60, 345/66, 67, 71, 87, 99, 62; 315/169.4
See application file for complete search history.

(56) References Cited

U.S. PATENT DOCUMENTS 6,097,365 A * 8/2000 Makino ..... 345/99
7,417,602 B2 * 8/2008 Mizuta ..... 345/60
7,612,740 B2 * 11/2009 Kim et al. ..... 345/63
2002/0024481 A1 * 2/2002 Kawabe et al. ..... 345/87
2003/0080932 A1 * 5/2003 Konno et al. ..... 345/96
2006/0114182 A1 * 6/2006 Su ..... 345/67
2006/0138974 A1 * 6/2006 Miyamae et al. ..... 315/500
2006/0145956 A1 * 7/2006 Myung ..... 345/67

FOREIGN PATENT DOCUMENTS

KR 2001-0029069 A 4/2001
KR 10-2004-0090583 A 10/2004

* cited by examiner

*Primary Examiner*—Douglas W Owens
*Assistant Examiner*—Tung X Le
(74) *Attorney, Agent, or Firm*—Birch, Stewart, Kolasch & Birch, LLP

(57) ABSTRACT

A plasma display apparatus is disclosed. The plasma display apparatus includes a plasma display panel including a plurality of data electrodes arranged in parallel to each other, and a data driver. The data driver applies a driving voltage to the plurality of data electrodes. The data driver includes a first connector and a second connector positioned at opposite edges of the plasma display panel, respectively. The first connector is electrically connected to some of the plurality of data electrodes, and the second connector is electrically connected to the date electrodes which are not connected to the first connector.

11 Claims, 8 Drawing Sheets

PLASMA DISPLAY APPARATUS

This application claims the benefit of Korean Patent Application No. 10-2006-0051654 filed on Jun. 8, 2006, which is hereby incorporated by reference.

BACKGROUND

1. Field

This document relates to a display apparatus, and more particularly, to a plasma display apparatus.

2. Description of the Related Art

A plasma display panel has the structure in which barrier ribs formed between a front panel and a rear panel partition one unit discharge cell. Each discharge cell is filled with an inert gas containing a main discharge gas such as neon (Ne), helium (He) and a mixture of Ne and He, and a small amount of xenon (Xe). The plurality of discharge cells form one pixel. For example, a red (R) discharge cell, a green (G) discharge cell, and a blue (B) discharge cell form one pixel.

When the plasma display panel is discharged by applying a high frequency voltage to the discharge cells, the inert gas generates vacuum ultraviolet rays, which thereby cause phosphors formed between the barrier ribs to emit light, thus displaying an image.

The plasma display panel includes a plurality of electrodes, for example, a scan electrode, a sustain electrode, and a data electrode. A plurality of drivers are connected to the plurality of electrodes, respectively, and thus applying driving voltages to the plurality of electrodes.

The drivers supply a reset pulse during a reset period, a scan pulse during an address period, and a sustain pulse during a sustain period to the electrodes during the driving of the plasma display panel, thereby displaying an image. Since the plasma display apparatus can be manufactured to be thin and light, it has attracted attention as a next generation display device.

Various factors may reduce the reliability of the driving of the plasma display apparatus when the plasma display apparatus is driven by applying the driving pulses to the electrodes. For example, a structural problem in the electrodes, the drivers, and connectors for connecting the electrodes and the drivers, and a problem in a driving waveform may make the driving of the plasma display apparatus unstable.

In particular, interference between the electrodes increases due to an increase in resolution of the plasma display apparatus, thereby generating a migration phenomenon.

There has been continuously studied to improve the stability in the driving of the plasma display apparatus in consideration of these problems.

In one aspect, a plasma display apparatus comprises a plasma display panel that includes a plurality of data electrodes arranged in parallel to each other, and a data driver that applies a driving voltage to the plurality of data electrodes, the data driver including a first connector and a second connector positioned at opposite edges of the plasma display panel, respectively, wherein the first connector is electrically connected to some of the plurality of data electrodes, and the second connector is electrically connected to the date electrodes which are not connected to the first connector.

A first data electrode of the plurality of data electrodes may be electrically connected to the first connector, and a second data electrode next to the first data electrode may be electrically connected to the second connector.

A distance between the two neighboring data electrodes connected to the first connector or a distance between the two neighboring data electrodes connected to the second connector may be longer than a distance between the two neighboring data electrodes on the plasma display panel.

The odd-numbered data electrodes among the plurality of data electrodes may be electrically connected to the first connector, and the even-numbered data electrodes among the plurality of data electrodes may be electrically connected to the second connector.

The first connector and the second connector each may be one of a flexible printed circuit (FPC), a tape carrier package (TCP), or a chip-on film (COF).

The size of the plasma display panel may be equal to or less than 50 inches.

In another aspect, a plasma display apparatus comprises a plasma display panel that includes a plurality of data electrodes arranged in parallel to each other and a plurality of sustain electrodes arranged to intersect the plurality of data electrodes, a data driver that includes a first connector and a second connector positioned at opposite edges of the plasma display panel, respectively, wherein the first connector is electrically connected to some of the plurality of data electrodes, and the second connector is electrically connected to the date electrodes which are not connected to the first connector, and a sustain driver that applies a driving voltage to the plurality of sustain electrodes, wherein the plurality of sustain electrodes are divided into a plurality of sustain electrode groups.

The plurality of sustain electrodes may be divided into two sustain electrode groups.

A first data electrode of the plurality of data electrodes may be electrically connected to the first connector, and a second data electrode next to the first data electrode may be electrically connected to the second connector.

A distance between the two neighboring data electrodes connected to the first connector or a distance between the two neighboring data electrodes connected to the second connector may be longer than a distance between the two neighboring data electrodes on the plasma display panel.

The odd-numbered data electrodes among the plurality of data electrodes may be electrically connected to the first connector, and the even-numbered data electrodes among the plurality of data electrodes may be electrically connected to the second connector.

The first connector and the second connector each may be one of a flexible printed circuit (FPC), a tape carrier package (TCP), or a chip-on film (COF).

The size of the plasma display panel may be equal to or less than 50 inches.

A first positive voltage level may be applied to a first sustain electrode group of the two sustain electrode groups during a period when scan electrodes corresponding to the first sustain electrode group are scanned, and a second positive voltage level lower than the first positive voltage level may be applied to a second sustain electrode group.

Scan electrodes corresponding to the second sustain electrode group may be scanned later than the scan electrodes corresponding to the first sustain electrode group.

The plasma display panel may include a plurality of scan electrodes arranged in parallel to the plurality of sustain electrodes. A set-down pulse applied to the plurality of scan electrodes may include a first set-down pulse falling from a first voltage level to a second voltage level and a second set-down pulse falling from the second voltage level to a third voltage level. The plurality of scan electrodes may be divided into a plurality of scan electrode groups. The first set-down pulse and the second set-down pulse may be successively applied to a first scan electrode group of the plurality of scan electrode groups. The first set-down pulse may be applied to a second scan electrode group that are scanned later than the first scan electrode group, a voltage of the second scan electrode group may be maintained at the second voltage level for a predetermined period of time, and then the second set-down pulse may be applied to the second scan electrode group.

The first voltage level may be a positive voltage level, the second voltage level may be a ground level voltage, and the third voltage level may be negative voltage level.

The first voltage level may be a positive voltage level, the second voltage level may be a negative voltage level, and the third voltage level may be a negative voltage level.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
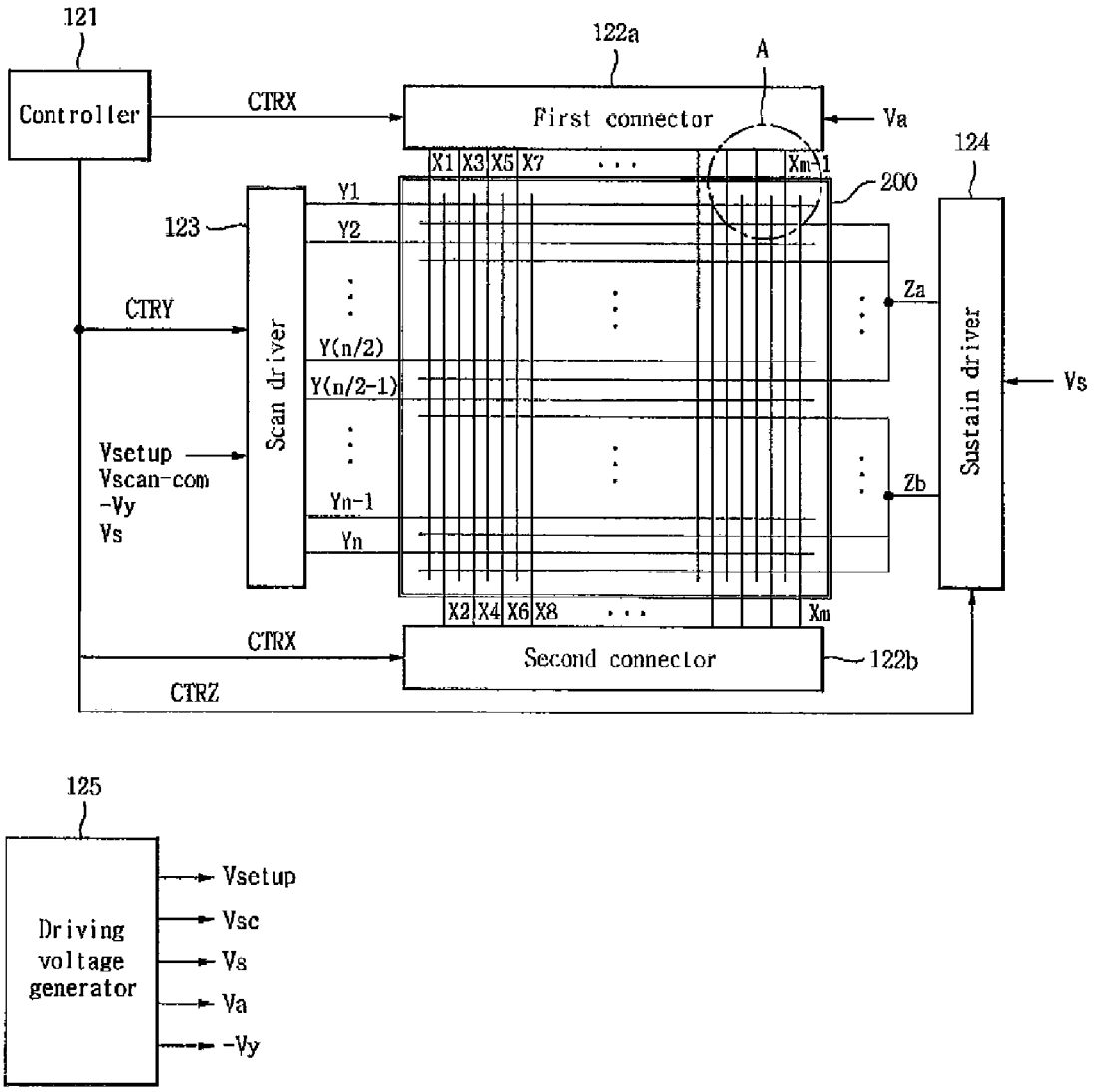
FIG. 1 illustrates a plasma display apparatus according to one embodiment.

FIG. 1 illustrates a plasma display apparatus according to one embodiment.

As illustrated in FIG. 1, the plasma display apparatus according to one embodiment includes a plasma display panel 200, on which an image is displayed by processing video data input from the outside, and a driver for applying driving pulses to electrodes formed in the plasma display panel 200.

The driver includes a data driver, a scan driver 123, a sustain driver 124, a controller 121, and a driving voltage generator 125. The data driver supplies data to data electrodes X1 to Xm, the scan driver 123 drives scan electrodes Y1 to Yn, and the sustain driver 124 drives sustain electrodes Z that are a common electrode. The controller 121 controls each driver, and the driving voltage generator 125 supplies a necessary driving voltage to each driver.

A front substrate (not shown) and a rear substrate (not shown) of the plasma display panel 200 are coalesced with each other with a given distance therebetween. On the front substrate, a plurality of electrodes, for example, the scan electrodes Y1 to Yn and the sustain electrodes Z are formed in pairs. On the rear substrate, the data electrodes X1 to Xm intersect the scan electrodes Y1 to Yn and the sustain electrodes Z.

In a general dual scanning driving method, data electrodes are separated to correspond to upper and lower portions of a rear substrate. However, in FIG. 1, the data electrodes are successively arranged from an upper portion to a lower portion of the rear substrate without separating. In other words, the plurality of data electrode lines corresponding to the number of discharge cells arranged in a transverse direction of the plasma display panel 200 are arranged on the rear substrate in parallel.

A portion of the data electrodes X1 to Xm thus arranged is electrically connected to the data driver through a first connector 122*a*. The remaining data electrodes except the portion of the data electrodes X1 to Xm (i.e., the data electrodes which are not electrically connected to the data driver through the first connector 122*a*) are electrically connected to the data driver through a second connector 122*b*. The first and second connectors 122*a* and 122*b* are positioned at opposite edges of the plasma display panel 200, respectively. The data, driver is electrically connected to the first and second connectors 122*a* and 122*b*, and thus applying a driving voltage to all the data electrodes X1 to Xm. The data driver is not limited to the above-described configuration. For example, the data driver may be formed in an integrated circuit (IC) form on the first and second connectors 122*a* and 122*b*, thereby making it possible to drive the data electrodes connected to integrated circuits of the first and second connectors 122*a* and 122*b*.

As above, the plurality of data electrodes that are successively arranged without separating are divided according to the connectors. An interference phenomenon between the data electrodes is prevented due to a change in a position for connecting the divided data electrodes to the data driver.

For example, the first data electrode X1 is electrically connected to the first connector 122*a*, and the second data electrode X2 next to the first data electrode X1 is electrically connected to the second connector 122*b*.

A distance between the two neighboring data electrodes connected to the first connector 122*a* or a distance between the two neighboring data electrodes connected to the second connector 122*b* is longer than a distance between the two neighboring data electrodes among all the data electrodes X1 to Xm arranged on the plasma display panel. The migration between the data electrodes is prevented by the above configuration of the data electrodes X1 to Xm.

Accordingly, the interference between the electrodes is reduced. This leads to an improvement in the stability of the driving of the plasma display apparatus. Further, the discharge accuracy can be improved due to the accurate application of the driving voltage.

The odd-numbered data electrodes X1, X3, X5, X7, . . . , Xm-1 are electrically connected to the first connector 122*a*, and the even-numbered data electrodes X2, X4, X6, X8, . . . , Xm are electrically connected to the second connector 122*b*. Accordingly, the distance between the two neighboring data electrodes connected to the first connector 122*a* or the distance between the two neighboring data electrodes connected to the second connector 122*b* is widened such that the electrical interference is prevented. The odd-numbered data electrodes X1, X3, X5, X7, . . . , Xm-1 may be electrically connected to the second connector 122*b*, and the even-numbered data electrodes X2, X4, X6, X8, . . . , Xm may be electrically connected to the first connector 122*a*.

The above-described electrode connection structure may be applied to plasma display apparatuses of 50 inches or less. As the size of plasma display apparatuses with the same resolution is reduced to 50 inches or less, a distance between electrodes is reduced. Accordingly, the above-described electrode connection structure prevents the migration phenomenon and the interference, that may be easily generated in an area A of FIG. 1, thereby securing the stability of the data electrodes.

The first and second connectors 122*a* and 122*b* may be formed in a flexible printed circuit (FPC) form for connecting the data electrodes to the data driver. Further, the first and second connectors 122*a* and 122*b* may be formed in an IC form such as a tape carrier package (TCP) or a chip-on film (COF) for applying the driving voltages to the data electrodes. Since the present embodiment is characterized in the configurations of the first and second connectors 122*a* and 122*b*, the configuration of the data driver is not limited.

The data driver receives data, which is inverse-gamma corrected and error-diffused by an inverse gamma correction circuit (not shown) and an error diffusion circuit (not shown) and then mapped in accordance with a subfield pattern previously set by a subfield mapping circuit (not shown) The data driver supplies the data, which is sampled and latched under the control of the controller 121, to the data electrodes X1 to Xm.

Under the control of the controller 121, the scan driver 123 supplies a reset pulse to the scan electrodes Y1 to Yn during a reset period, thereby initializing discharge cells corresponding to the whole screen. After supplying the reset pulse, the scan driver 123 supplies a scan reference voltage Vsc and a scan signal, which falls from the scan reference voltage Vsc to a negative voltage level, to the scan electrodes Y1 to Yn during an address period, thereby scanning the scan electrode lines.

The scan driver 123 supplies a sustain pulse to the scan electrodes Y1 to Yn during a sustain period, thereby generating a sustain discharge within the discharge cells selected during the address period.

Under the control of the controller 121, the sustain driver 121 supplies a sustain pulse to the sustain electrodes Z during the sustain period. At this time, the scan driver 123 and the sustain driver 124 alternately operate.

The controller 121 receives a vertical/horizontal synchronization signal. The controller 121 generates timing control signals CTRX, CTRY and CTRZ required in each driver. The controller 121 supplies the timing control signals CTRX, CTRY and CTRZ to each of the corresponding drivers, thereby controlling the drivers. The timing control signals CTRX applied to the data driver includes a sampling clock for sampling data, a latch control signal, and a switch control signal for controlling on/off time of an energy recovery circuit and a driving switch element. The timing control signals CTRY applied to the scan driver 123 includes a switch control signal for controlling on/off time of an energy recovery circuit installed in the scan driver 123 and a driving switch element. The timing control signals CTRZ applied to the sustain driver 124 includes a switch control signal for controlling on/off time of an energy recovery circuit installed in the sustain driver 124 and a driving switch element.

The driving voltage generator 125 generates various driving voltages such as a sustain voltage Vs, a scan reference voltage Vsc, a data voltage Va, a scan voltage −Vy, required in each driver. The driving voltages may be varied depending on a composition of a discharge gas or the structure of the discharge cells.

Figure 2:
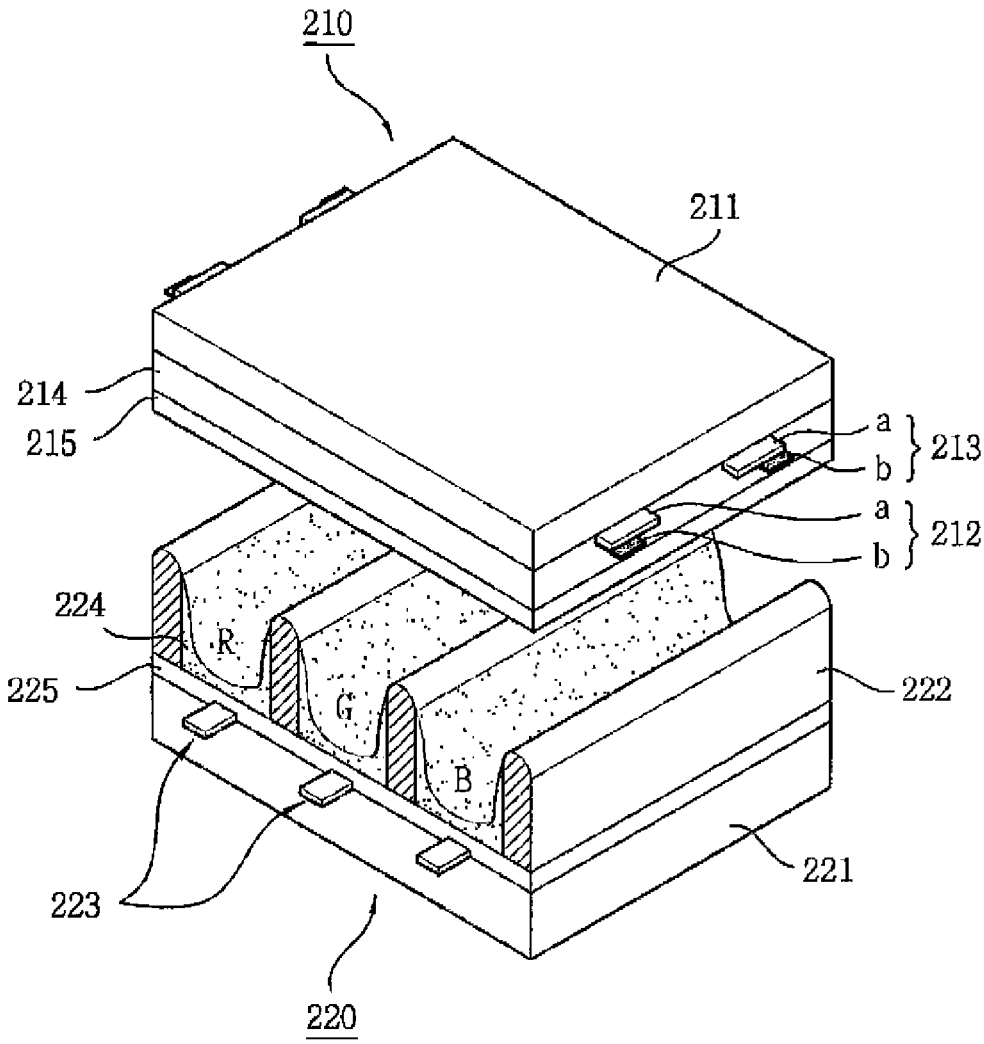
FIG. 2 illustrates one example of the structure of a plasma display panel of the plasma display apparatus according to one embodiment.

FIG. 2 illustrates one example of the structure of a plasma display panel of the plasma display apparatus according to one embodiment.

As illustrated in FIG. 2, the plasma display panel includes a front panel 210 and a rear panel 220 which are coupled in parallel to oppose to each other at a given distance therebetween. The front panel 210 includes a front substrate 211 which is a display surface, and the rear panel 220 includes a rear substrate 221 constituting a rear surface. A plurality of scan electrodes 212 and a plurality of sustain electrodes 213 are formed in pairs on the front substrate 211, on which an image is displayed, to form a plurality of maintenance electrode pairs. A plurality of data electrodes 223 are arranged on the rear substrate 221 to intersect the plurality of maintenance electrode pairs.

The scan electrode 212 and the sustain electrode 213 each include transparent electrodes 212*a* and 213*a* made of a transparent indium-tin-oxide (ITO) material and bus electrodes 212*b* and 213*b* made of a metal material. The scan electrode 212 and the sustain electrode 213 may include each either the transparent electrode or the bus electrode. The scan electrode 212 and the sustain electrode 213 generate a mutual discharge therebetween in one discharge cell and maintain light-emissions of discharge cells. The scan electrode 212 and the sustain electrode 213 are covered with one or more upper dielectric layers 214 for limiting a discharge current and providing insulation between the maintenance electrode pairs. A protective layer 215 with a deposit of MgO is formed on an upper surface of the upper dielectric layer 214 to facilitate discharge conditions.

A plurality of stripe-type or well-type barrier ribs 222 are formed on the rear substrate 221 of the rear panel 220 to form a plurality of discharge spaces, i.e., a plurality of discharge cells. The plurality of data electrodes 223 for performing an address discharge to generate vacuum ultraviolet rays are arranged in parallel to the barrier ribs 222.

An upper surface of the rear substrate 221 is coated with red (R), green (G) and blue (B) phosphors 224 for emitting visible light for an image display during the generation of the address discharge. A lower dielectric layer 225 is formed between the data electrodes 223 and the phosphors 224 to protect the data electrodes 223.

The front panel 210 and the rear panel 220 thus formed are coalesced using a sealing process to complete the plasma display panel is completed. The drivers for driving the scan electrode 212, the sustain electrode 213 and the data electrode 223 are attached to the plasma display panel to complete the plasma display apparatus.

Figure 3:
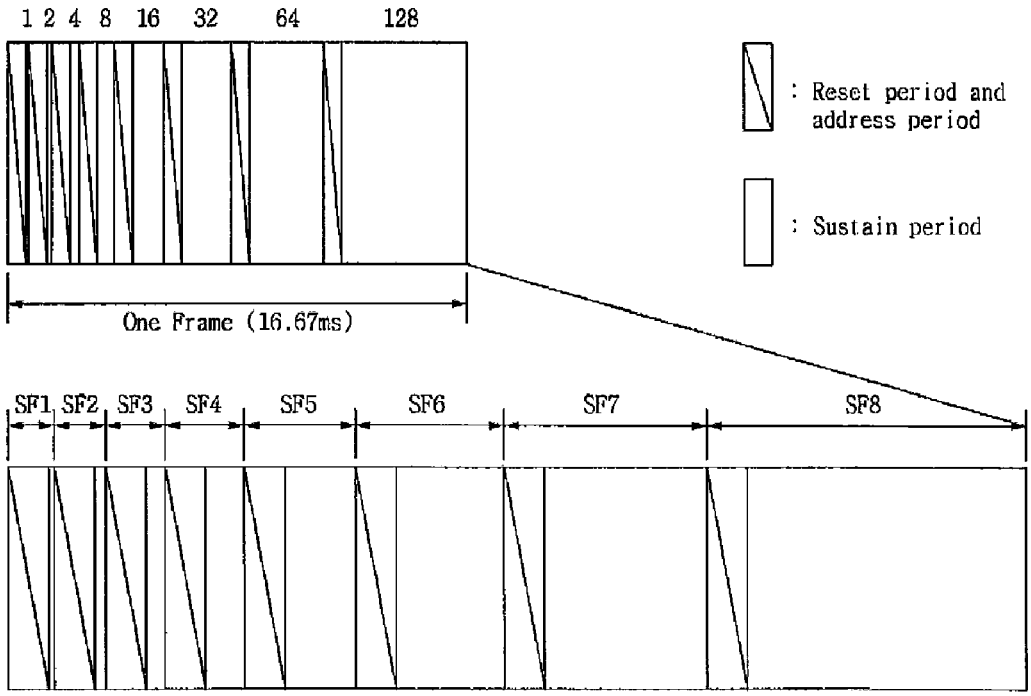
FIG. 3 illustrates an example of a method for representing a gray level of an image in the plasma display panel according to one embodiment.

FIG. 3 illustrates an example of a method for representing a gray level of an image in the plasma display panel according to one embodiment.

As illustrated in FIG. 3, the plasma display apparatus for displaying an image on the plasma display panel is driven with a frame being divided into a plurality of subfields. For example, each subfield is subdivided into a reset period for initializing all the cells, an address period for selecting cells to be discharged, and a sustain period for representing a gray level in accordance with the number of discharges.

For example, if an image with a gray level of 256 is to be displayed, a frame period (16.67 ms) corresponding to 1/60 sec is divided into a plurality of subfields, for example, 8 subfields SF1 to SF8. Each of the eight subfields SF1 to SF8 is subdivided into a reset period, an address period, and a sustain period. A duration of the reset period in a subfield is equal to durations of the reset periods in the other subfields. A duration of the address period in a subfield is equal to durations of the address periods in the other subfields. However, a duration of the sustain period of each subfield may be different from one another, and the number of sustain pulses assigned during the sustain period of each subfield may be different from one another. For example, the sustain period increases in a ratio of $2^n$ (where, n=0, 1, 2, 3, 4, 5, 6, 7) in each subfield such that a gray level of an image is represented.

Figure 4:
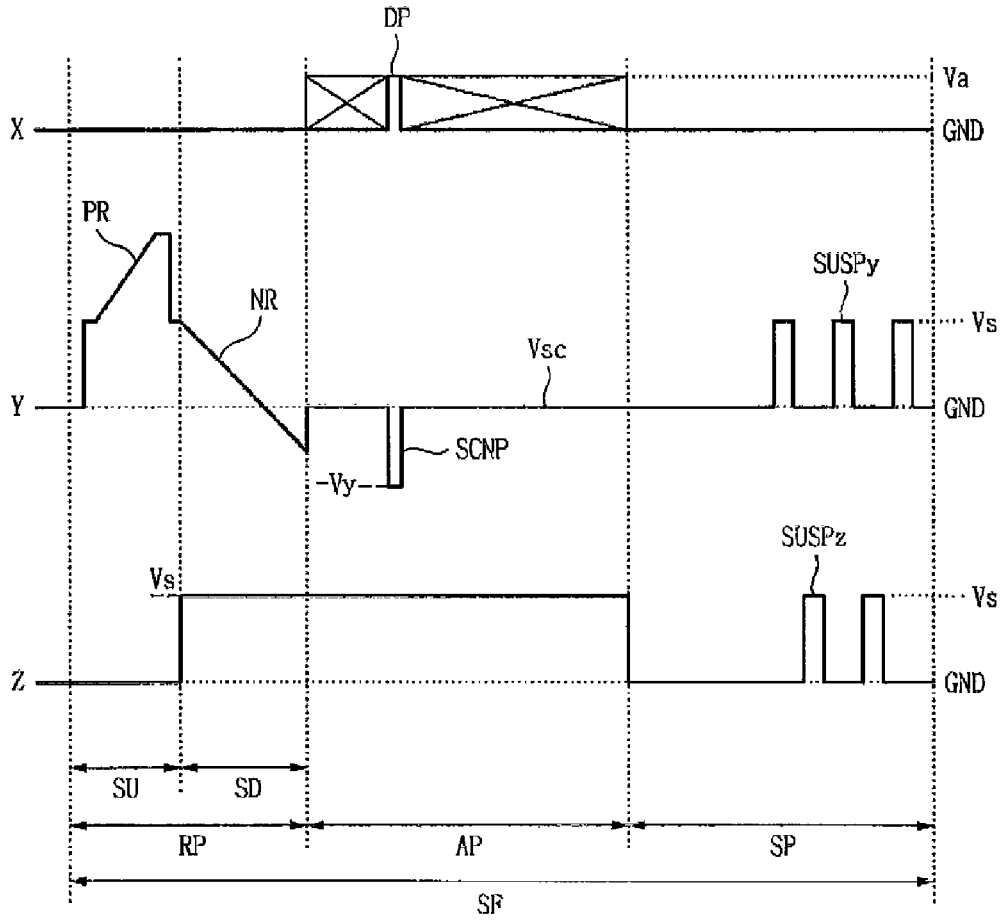
FIG. 4 illustrates a driving method of the plasma display apparatus according to one embodiment.

FIG. 4 illustrates a driving method of the plasma display apparatus according to one embodiment.

FIG. 4 illustrates a driving waveform in one subfield of the plurality of subfields.

A subfield SF is divided into a reset period RP for initializing discharge cells of the whole screen, an address period AP for selecting cells to be discharged, and a sustain period SP for displaying an image by maintaining the selected discharge cells in a discharge state.

The reset period RP is further divided into a setup period SU and a set-down period SD. During the setup period SU, a setup pulse PR of a high voltage is simultaneously applied to the scan electrodes Y. The setup pulse PR generates a weak discharge (i.e., a setup discharge) within the discharge cells of the whole screen, thereby producing wall charges within the discharge cells.

During the set-down period SD, a set-down pulse NR is simultaneously applied to the scan electrodes Y, thereby generating a weak erase discharge within the discharge cells. Furthermore, the remaining wall charges are uniformly distributed inside the discharge cells.

A positive voltage level is applied to the sustain electrodes Z during the set-down period SD and the address period AP such that an erroneous discharge does not occur between the scan electrodes Y and the sustain electrodes Z.

During the address period AP, a scan pulse SCNP with a voltage −Vy is applied to the scan electrodes Y and, at the same time, a data pulse DP is applied to the data electrodes X. As the voltage difference between the scan pulse SCNP and the data pulse DP is added to the wall voltage generated during the reset period RP, the address discharge occurs within the discharge cells to which the data pulse DP is applied. Wall charges are produced inside the cells selected by performing the address discharge.

During the sustain period SP, a sustain pulse SUSP is alternately applied to the scan electrode Y and the sustain electrode Z, thereby generating a sustain discharge.

As above, in the driving method of the plasma display apparatus according to one embodiment, the interference phenomenon between the electrodes is solved such that the discharge accuracy is improved due to the exact supply of the driving voltage.

Another embodiment of driving method of the plasma display apparatus capable of improving the discharge stability will be described in detail below.

Figure 5:
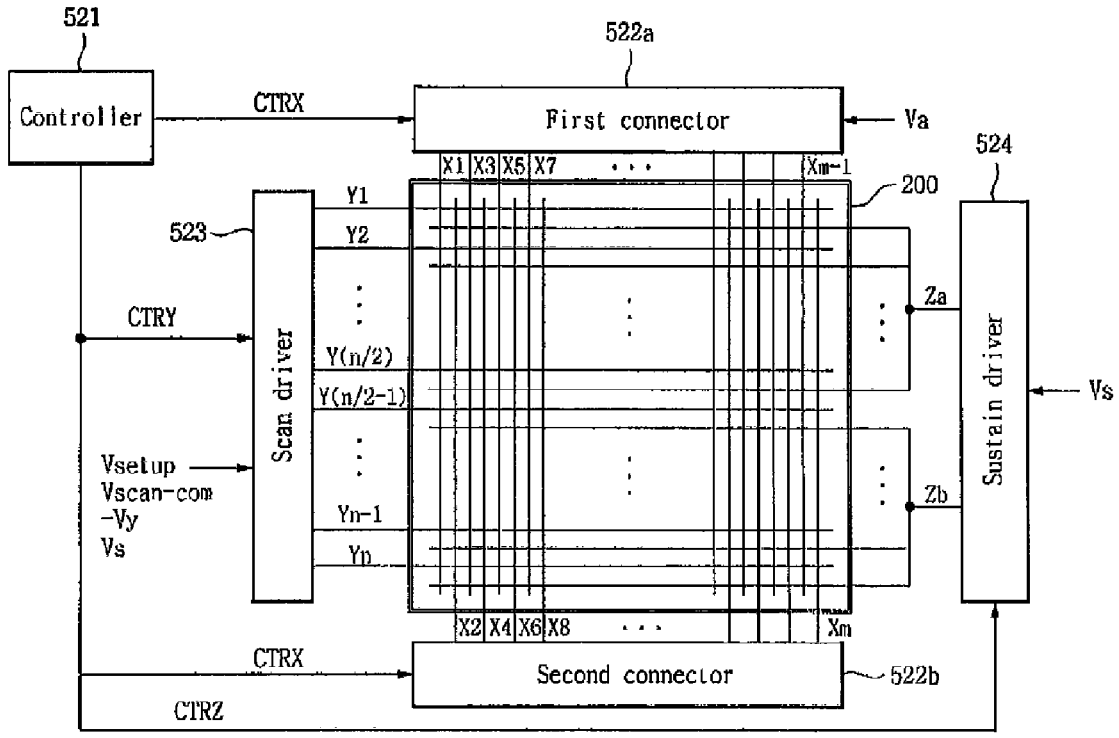
FIG. 5 illustrates a plasma display apparatus according to another embodiment.
Figure 5:
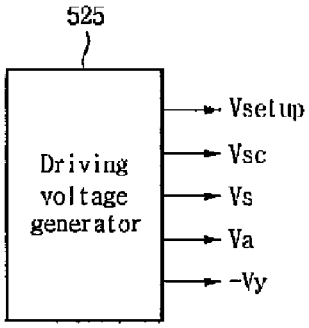

FIG. 5 illustrates a plasma display apparatus according to another embodiment.

As illustrated in FIG. 5, the plasma display apparatus according to another embodiment includes a plasma display panel 200, on which an image is displayed by the process of video data input from the outside, and a driver for applying driving pulses to electrodes formed in the plasma display panel 200.

The driver includes a data driver, a scan driver 523, a sustain driver 524, a controller 521, and a driving voltage generator 525. The data driver supplies data to data electrodes X1 to Xm, the scan driver 523 drives scan electrodes Y1 to Yn, and the sustain driver 524 drives sustain electrodes Z that are a common electrode. The controller 521 controls each driver, and the driving voltage generator 525 supplies a necessary driving voltage to each driver.

A front substrate (not shown) and a rear substrate (not shown) of the plasma display panel 200 are coalesced with each other with a given distance therebetween. On the front substrate, a plurality of electrodes, for example, the scan electrodes Y1 to Yn and the sustain electrodes Z are formed in pairs. On the rear substrate, the data electrodes X1 to Xm intersect the scan electrodes Y1 to Yn and the sustain electrodes Z.

In a general dual scanning driving method, the data electrodes are separated to correspond to upper and lower portions of the rear substrate. However, in FIG. 5, the data electrodes are successively arranged from an upper portion to a lower portion of the rear substrate without separating. In other words, the plurality of data electrode lines corresponding to the number of discharge cells arranged in a transverse direction of the plasma display panel 200 are arranged on the rear substrate in parallel.

A portion of the data electrodes X1 to Xm thus arranged is electrically connected to the data driver through a first connector 522*a*. The remaining data electrodes except the portion of the data electrodes X1 to Xm (i.e., the data electrodes which are not electrically connected to the data driver through the first connector 522*a*) are electrically connected to the data driver through a second connector 522*b*. The first and second connectors 522*a* and 522*b* are positioned at opposite edges of the plasma display panel 200, respectively. The data driver is electrically connected to the first and second connectors 522*a* and 522*b*, and thus applying a driving voltage to all the data electrodes X1 to Xm. The data driver is not limited to the above-described configuration. For example, the data driver may be formed in an integrated circuit (IC) form on the first and second connectors 522*a* and 522*b*, thereby making it possible to drive the data electrodes connected to integrated circuits of the first and second connectors 522*a* and 522*b*.

As above, the plurality of data electrodes that are successively arranged without separating are divided according to the connectors. An interference phenomenon between the data electrodes is prevented due to a change in a position for connecting the divided data electrodes to the data driver.

In another embodiment, the plurality of sustain electrodes are divided into a plurality of sustain electrode groups. For example, the plurality of sustain electrodes are divided into two sustain electrode groups Za and Zb such that the discharge accuracy is improved due to the application of different voltages to the two sustain electrode groups Za and Zb.

The data electrode X1 is electrically connected to the first connector 522*a*, and the second data electrode X2 next to the first data electrode X1 is electrically connected to the second connector 522*b*.

A distance between the two neighboring data electrodes connected to the first connector 522*a* or a distance between the two neighboring data electrodes connected to the second connector 522*b* is longer than a distance between the two neighboring data electrodes among all the data electrodes X1 to Xm arranged on the plasma display panel. The migration between the data electrodes is prevented by the above configuration of the data electrodes X1 to Xm.

Accordingly, the interference between the electrodes is reduced. This leads to an improvement in the stability of the driving of the plasma display apparatus. Further, the discharge accuracy can be improved due to the accurate application of the driving voltage.

The odd-numbered data electrodes X1, X3, X5, X7, . . . , Xm-1 are electrically connected to the first connector 522*a*, and the even-numbered data electrodes X2, X4, X6, X8, . . . , Xm are electrically connected to the second connector 522*b*. Accordingly, the distance between the two neighboring data electrodes connected to the first connector 522*a* or the distance between the two neighboring data electrodes connected to the second connector 522*b* is widened such that the electrical interference is prevented. The odd-numbered data electrodes X1, X3, X5, X7, . . . , Xm-1 may be electrically connected to the second connector 522*b*, and the even-numbered data electrodes X2, X4, X6, X8, . . . , Xm may be electrically connected to the first connector 522*a*.

The above-described electrode connection structure is applied to plasma display apparatuses of 50 inches or less. As the size of plasma display apparatuses with the same resolution is reduced to 50 inches or less, a distance between the electrodes is reduced. Accordingly, the above-described electrode connection structure prevents the migration phenomenon and the interference, that may be easily generated in an area A of FIG. 1, thereby securing the stability of the data electrodes.

The first and second connectors 522*a* and 522*b* may be formed in a FPC form for connecting the data electrodes to the data driver. Further, the first and second connectors 522*a* and 522*b* may be formed in an IC form such as a TCP or a COF for applying the driving voltage to the data electrodes. Since the present embodiment is characterized in the configurations of the first and second connectors 522*a* and 522*b*, the configuration of the data driver is not limited.

Since the data driver, the scan driver 523, the sustain driver 524, the controller 521, and the driving voltage generator 525 were described with reference to FIG. 1, a description thereof are omitted in another embodiment. However, the configurations of the data driver, the scan driver 523, and the sustain driver 524 are not limited to the configuration illustrated in FIG. 1.

Figure 6A:
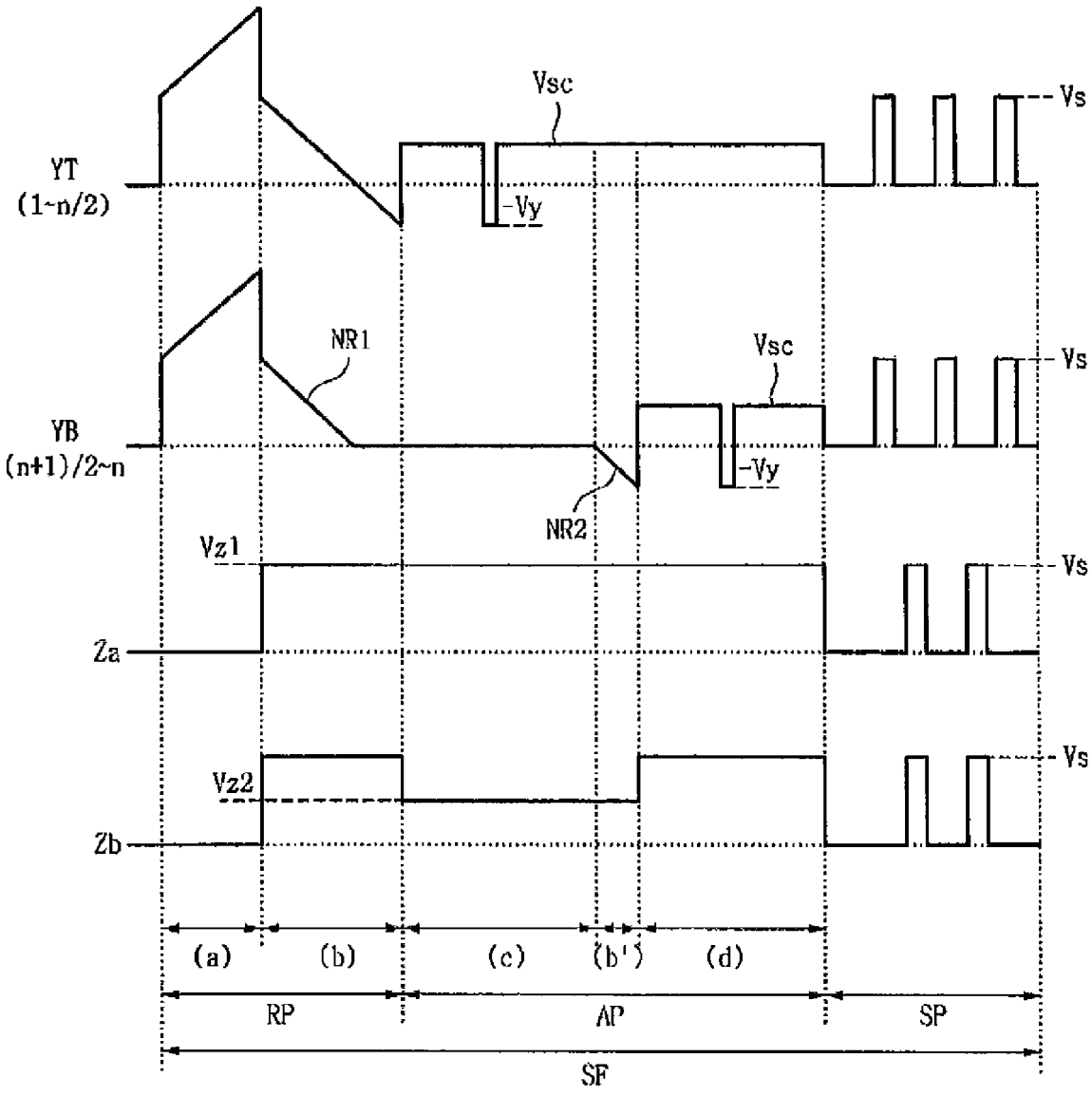
FIGS. 6*a* and 6*b* illustrate a driving method of the plasma display apparatus of FIG. 5 and a state of wall charges distributed depending on the driving method.
Figure 6B:
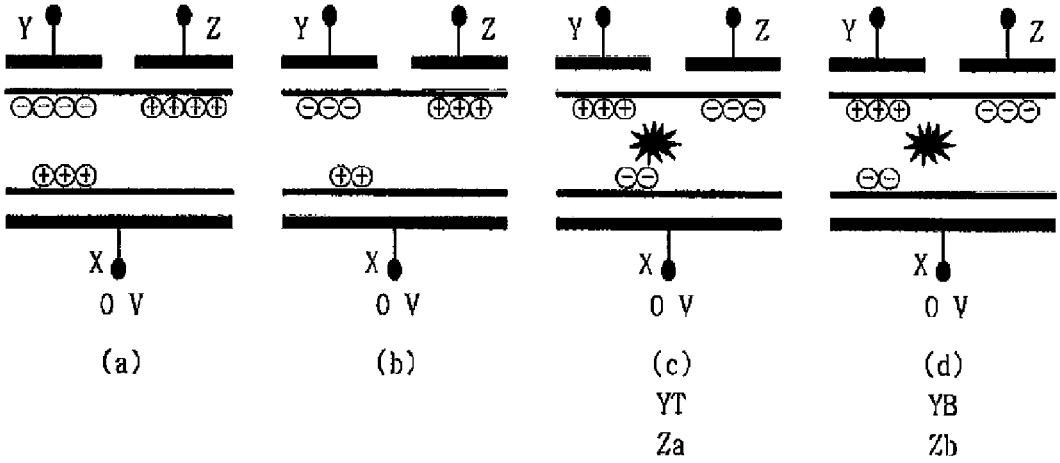

FIGS. 6*a* and 6*b* illustrate a driving method of the plasma display apparatus of FIG. 5 and a state of wall charges distributed depending on the driving method.

FIG. 6*a* illustrates a driving waveform in one subfield of the plurality of subfields.

A subfield SF is divided into a reset period RP for initializing discharge cells of the whole screen, an address period AP for selecting cells to be discharged, and a sustain period SP for displaying an image by maintaining the selected discharge cells in a discharge state.

Since driving waveforms generated during the above periods were described in FIG. 4, a description of the driving waveforms is not omitted in FIG. 6*a*. However, the driving waveform illustrated in FIG. 6*a* is not limited to the driving waveform illustrated in FIG. 4.

In another embodiment, the sustain electrodes are divided into the plurality of sustain electrode groups, and a positive voltage level applied to the plurality of sustain electrode groups during the address period AP is controlled. Accordingly, the driving conditions are optimized.

For example, different positive voltages levels may be applied to the first and second sustain electrode groups Za and Zb during the address period, respectively. During a period (c) when the scan electrodes corresponding to the first sustain electrode group Za are scanned, a first positive voltage Vz1 is applied to the first sustain electrode group Za, and a second positive voltage Vz2, that is lower than the first positive voltage Vz1, is applied to the second sustain electrode group Zb. Then, the scan electrodes corresponding to the second sustain electrode group Zb are scanned later than the scan electrodes corresponding to the first sustain electrode group Za during the address period. Accordingly, an address discharge is generated more exactly.

As above, since a magnitude of the positive voltage level applied to the sustain electrodes is controlled in accordance with the scanning order, the intensity of the address discharge is uniform in all the discharge cells during the address period. Accordingly, the discharge accuracy is improved and the discharge stability is improved.

Further, the scan electrodes are divided into a plurality of scan electrode groups to correspond to the plurality of sustain electrode groups, and supply time of a set-down pulse applied to each scan electrode group is controlled. The set-down pulse includes a first set-down pulse falling from a first voltage level to a second voltage level and a second set-down pulse falling from the second voltage level to a third voltage level.

For example, a first set-down pulse NR1 and a second set-down pulse NR2 are successively applied to a first scan electrode group YT of the plurality of scan electrode groups. The first set-down pulse NR1 falling from a positive voltage level to a ground level voltage is applied to a second scan electrode group YB, that is scanned later than the first scan electrode group YT. Then, after maintaining at the ground level voltage for a predetermined period of time, the second set-down pulse NR2 falling from the ground level voltage to a negative voltage level is applied to the second scan electrode group YB. In other words, the set-down pulse is applied to the later scanned scan electrode group YB later than the earlier scanned scan electrode group YT. This results in the compensation for the instability of the address discharge due to the erased wall charges after the reset period. The erase of the wall charges is prevented by controlling the supply time of the set-down pulse applied to the plurality of scan electrode groups in accordance with the scanning order.

As above, the address discharge uniformly occurs in all the discharge cells by the control of the supply time of the set-down pulse in accordance with the generation order of the address discharge, i.e., the scanning order during the address period.

FIG. 6*b* illustrates a state of wall charges produced depending on a driving waveform of FIG. 6*a*.

First, (a) of FIG. 6*b* illustrates that wall charges are sufficiently accumulated inside the discharge cells due to a setup discharge.

Next, (b) of FIG. 6*b* illustrates that the excessively accumulated wall charges remain uniform due to the set-down discharge. The first set-down pulse NR1 gradually falling from the first voltage level to the second voltage level is applied to the second scan electrode group YB, and then, the voltage of the second scan electrode group YB is maintained at the second voltage level. In other words, the voltage of the second scan electrode group YB is maintained at a voltage level that is higher than the lowest voltage level of the set-down pulse such that the erase of the wall charges is prevented by maintaining in a state in which the excessively accumulated wall charges is not sufficiently erased.

Next, (c) of FIG. 6*b* illustrates that the address discharge occurs by scanning the first scan electrode group YT and polarities of the wall charges accumulated on the electrodes are reversed. The voltage of the second scan electrode group YB is maintained at the second voltage level (for example, the ground level voltage of FIG. 6*a*) until the period (c) of FIG. 6*a*. Then, before generating the address discharge in the second scan electrode group YB (i.e., after the first scan electrode group YT is all scanned), the second set-down pulse gradually falling from the second voltage level to the third voltage level is applied to the second scan electrode group YB during a period (b') of FIG. 6*a*. Thus, the supply of the set-down pulse is completed.

During the periods (b) and (c), the first positive voltage Vz1 is applied to the first sustain electrode group Za. The first positive voltage Vz1 is applied to the second sustain electrode group Zb during the period (b), and then the second positive voltage Vz2, that is lower than the first positive voltage Vz1, is applied to the second sustain electrode group Zb during the period (c) when the first scan electrode group YT is scanned. In this case, the first scan electrode group YT corresponds to the first sustain electrode group Za, and the second scan electrode group YB corresponds to the first sustain electrode group Zb. Accordingly, the erase of the wall charges is minimized. During the period (c), the address discharge occurs in the discharge cells of the first sustain electrode group Za and the wall charges remains uniform in the discharge cells of the second sustain electrode group Zb.

Next, during a period (d), the second scan electrode group YB corresponding to the second sustain electrode group Zb are scanned such that the address discharge occurs. During the period (d), the first positive voltage VZ1 is applied to the first sustain electrode group Za corresponding to the first scan electrode group YT, thereby easily generating the address discharge.

As above, in the reared art, during the period (d), an erroneous discharge occurred or it was difficult to generate the address discharge due to the erase of the wall charges. However, since the erase of the wall charges is minimized by controlling the positive voltage level applied to the sustain electrode or the set-down pulse applied to the scan electrode in consideration of the scanning order, the address discharge is certainly generated as illustrated in (d) of FIG. 6*b*. Accordingly, the discharge accuracy is improved, and the driving stability is secured.

As above, the driving accuracy is improved by preventing the erase of the wall charges. For example, as the duration of the address period increases in the plasma display apparatus at high resolution or a high temperature, the wall charges inside the discharge cells are easily erased. For this, in the embodiments, the discharge is generated more exactly by controlling the supply time of the driving voltage without a change in a magnitude of the driving voltage. Further, the interference between the electrodes is prevented such that the driving reliability is improved due to the control of the supply time of the driving voltage.

Figure 7:
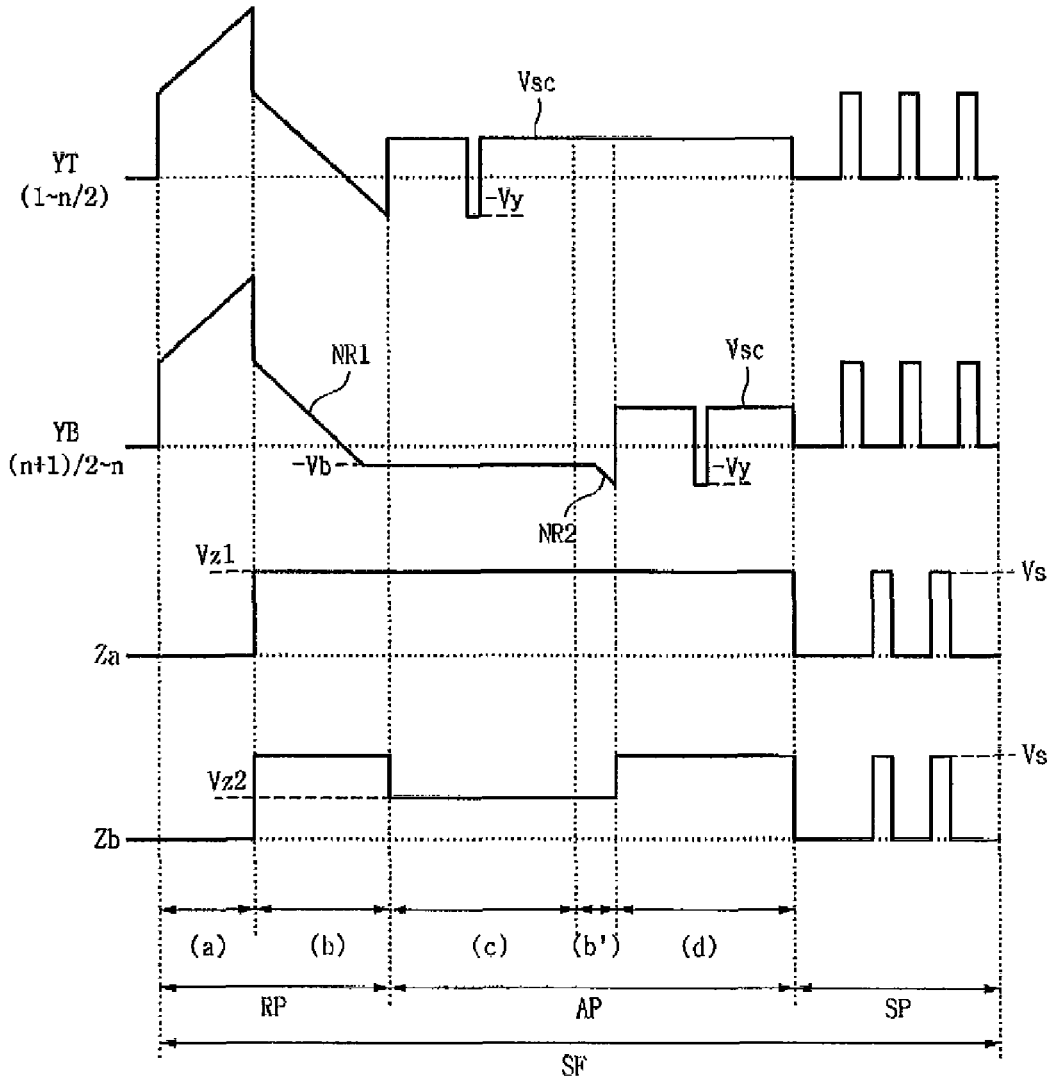
FIG. 7 illustrates another driving method of the plasma display apparatus of FIG. 5.

FIG. 7 illustrates another driving method of the plasma display apparatus of FIG. 5.

FIG. 7 illustrates a driving waveform in one subfield of the plurality of subfields.

A subfield SF is divided into a reset period RP for initializing discharge cells of the whole screen, an address period AP for selecting cells to be discharged, and a sustain period SP for displaying an image by maintaining the selected discharge cells in a discharge state.

Since driving waveforms generated during these periods were described in FIG. 6*a*, the description is omitted in FIG. 7.

Unlike the driving waveform illustrated in FIG. 6*a*, the set-down pulse applied to the second scan electrode group YB is controlled differently.

The plurality of sustain electrodes are divided into a plurality of sustain electrode groups, and the scan electrodes are divided into a plurality of scan electrode groups to correspond to the plurality of sustain electrode groups. Supply time of a set-down pulse applied to each scan electrode group is controlled.

A set-down pulse includes a first set-down pulse falling from a first voltage level (i.e., a positive voltage level) to a second voltage level (i.e., a negative voltage level), and a second set-down pulse falling from the second voltage level to a third voltage level that is lower than the second voltage level. The first set-down pulse NR1 and the second set-down pulse NR2 are successively applied to a first scan electrode group YT of the plurality of scan electrode groups. The first set-down pulse NR1 is applied to a second scan electrode group YB, that is scanned later than the first scan electrode group YT. Then, after maintaining at the second voltage level for a predetermined period of time, the second set-down pulse NR2 is applied to the second scan electrode group YB. Accordingly, addressing time is reduced by reducing a supply time (b')of the second set-down pulse NR2 applied to the second scan electrode group YB.

In other words, the control of the supply time of the set-down pulse compensates for the erase of wall charges, thereby improving the driving accuracy. The interference between the electrodes is prevented and the driving accuracy is improved by controlling a connection relationship between the data electrodes.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel that includes a plurality of data electrodes arranged in parallel to each other and a plurality of sustain electrodes arranged to intersect the plurality of data electrodes;

a data driver that includes a first connector and a second connector positioned at opposite edges of the plasma display panel, respectively, wherein the first connector is electrically connected to some of the plurality of data electrodes, and the second connector is electrically connected to the data electrodes which are not connected to the first connector; and a sustain driver that applies a driving voltage to the plurality of sustain electrodes, wherein the plurality of sustain electrodes are divided into a plurality of sustain electrode groups, wherein the plurality of sustain electrodes are divided into two sustain electrode groups, and wherein a first positive voltage level is applied to a first sustain electrode group of the two sustain electrode groups during a period when scan electrodes corresponding to the first sustain electrode group are scanned, and a second positive voltage level lower than the first positive voltage level is applied to a second sustain electrode group.

2. The plasma display apparatus of claim 1, wherein a first data electrode of the plurality of data electrodes is electrically connected to the first connector, and a second data electrode next to the first data electrode is electrically connected to the second connector.

3. The plasma display apparatus of claim 2, wherein a distance between the two neighboring data electrodes connected to the first connector or a distance between the two neighboring data electrodes connected to the second connector is longer than a distance between the two neighboring data electrodes on the plasma display panel.

4. The plasma display apparatus of claim 3, wherein the odd-numbered data electrodes among the plurality of data electrodes are electrically connected to the first connector, and the even-numbered data electrodes among the plurality of data electrodes are electrically connected to the second connector.

5. The plasma display apparatus of claim 1, wherein the first connector and the second connector each are one of a flexible printed circuit (FPC), a tape carrier package (TCP), or a chip-on film (COF).

6. The plasma display apparatus of claim 1, wherein the size of the plasma display panel is equal to or less than 50 inches.

7. The plasma display apparatus of claim 1, wherein scan electrodes corresponding to the second sustain electrode group is scanned later than the scan electrodes corresponding to the first sustain electrode group.

8. The plasma display apparatus of claim 1, wherein the plasma display panel includes a plurality of scan electrodes arranged in parallel to the plurality of sustain electrodes, a set-down pulse applied to the plurality of scan electrodes includes a first set-down pulse falling from a first voltage level to a second voltage level and a second set-down pulse falling from the second voltage level to a third voltage level, the plurality of scan electrodes are divided into a plurality of scan electrode groups, the first set-down pulse and the second set-down pulse are successively applied to a first scan electrode group of the plurality of scan electrode groups, and the first set-down pulse is applied to a second scan electrode group that are scanned later than the first scan electrode group, a voltage of the second scan electrode group is maintained at the second voltage level for a predetermined period of time, and then the second set-down pulse is applied to the second scan electrode group.

9. The plasma display apparatus of claim 8, wherein the first voltage level is a positive voltage level, the second voltage level is a ground level voltage, and the third voltage level is a negative voltage level.

10. The plasma display apparatus of claim 8, wherein the first voltage level is a positive voltage level, the second voltage level is a negative voltage level, and the third voltage level is a negative voltage level.

11. A plasma display apparatus, comprising:

a plasma display panel that includes a plurality of data electrodes arranged in parallel to each other and a plurality of sustain electrodes arranged to intersect the plurality of data electrodes;

a data driver that includes a first connector and a second connector positioned at opposite edges of the plasma display panel, respectively, wherein the first connector is electrically connected to a first data electrode, and the second connector is electrically connected to a second date electrode which is adjacent to the first data electrode; and a sustain driver that applies a driving voltage to the plurality of sustain electrodes, wherein a first positive voltage level is applied to a first sustain electrode during a period when scan electrode corresponding to the first sustain electrode are scanned, and a second positive voltage level lower than the first positive voltage level is applied to a second sustain electrode.

* * * * *